US005966971A

United States Patent [19]

Keller

[11] Patent Number: 5,966,971

[45] Date of Patent: Oct. 19, 1999

[54] LOCK BOLT

[76] Inventor: Ernst Keller, Untere Schwandenstrasse 22, 8805 Richterswil, Switzerland

[21] Appl. No.: 09/095,140

[22] Filed: Jun. 10, 1998

Related U.S. Application Data

[63] Continuation-in-part of application No. 08/713,767, Sep. 13, 1996, abandoned.

[30] Foreign Application Priority Data

Sep. 15, 1995 [CH] Switzerland ..... 2607/95

[51] Int. Cl.[6] ..... E05B 27/04

[52] U.S. Cl. ..... 70/359; 70/378; 70/419; 70/493

[58] Field of Search ..... 70/359, 493, 494, 70/378, 392, 358, 419, DIG. 22

[56] References Cited

U.S. PATENT DOCUMENTS

| | | | |
|---|---|---|---|
| 3,125 | 6/1843 | Voorhies | 70/359 |
| 593,436 | 11/1897 | Rydberg | 70/359 |
| 917,365 | 4/1909 | Schoell | 70/359 |
| 1,095,500 | 5/1914 | Hansen | 70/359 |
| 1,696,829 | 12/1928 | Wise | 70/359 |
| 2,653,467 | 9/1953 | Segal | 70/493 X |
| 3,818,732 | 6/1974 | Tria, Jr. et al. | 70/359 |
| 4,403,486 | 9/1983 | Miyake | 70/493 X |
| 5,123,768 | 6/1992 | Eizen | 70/359 |
| 5,222,383 | 6/1993 | Fann et al. | 70/359 X |
| 5,457,974 | 10/1995 | Keller | 70/359 X |

FOREIGN PATENT DOCUMENTS

| | | | |
|---|---|---|---|
| 0238442 | 9/1987 | European Pat. Off. | 70/493 |
| 0909253 | 5/1946 | France | 70/493 |
| 87/05654 | 9/1987 | WIPO . | |

*Primary Examiner*—Lloyd A. Gall
*Attorney, Agent, or Firm*—Browdy and Neimark

[57] ABSTRACT

The lock bolt has a bolt tip (2) a bolt head (3) whose back wall (4) is intended to rest against a housing pin for sliding this pin into the rotary closure cylinder (24). The bolt tip (2) is supported on the bolt head (3) with a spring engaged between the bolt tip (2) and the bolt head (3) so that it can slide in a limited fashion between an inner and an outer position. The bolt head (3) has a longitudinal bore (5) in which the bolt tip (2) is supported so that it can slide. The lock bolt to a large extent prevents unlocking attempts in which vibrational movements are exerted on the tumblers.

19 Claims, 2 Drawing Sheets

LOCK BOLT

CROSS-REFERENCE TO RELATED APPLICATION

This application is a continuation-in-part of U.S. application Ser. No. 08/713,767, filed Sep. 13, 1996 and now abandoned.

BACKGROUND OF THE INVENTION

1. Technical Field of the Invention

The invention relates to a lock bolt for a rotary closure cylinder of a safety lock, having a bolt tip and a bolt head whose back end is intended to rest against a housing pin when slid radially outward for sliding the housing pin into the rotating closure cylinder.

2. Prior Art

Lock bolts of this kind have been known for a long time. They are also called core pins and in a rotary closure cylinder, form the part of the tumblers that is supported in a radial stepped bore of the rotor. Lock bolts of this kind have been disclosed for example in the applicant's WO 87/05654. These each have a sleeve-shaped slider element that makes it difficult to immobilize the lock bolt when attempting to damage it. The security of rotary closure cylinders is also impaired by so-called "electropicks". With these, a tool is used to spin the rotor around its rotational axis with a particular torque and at the same time, the tumblers are moved radially outward by means of vibration until all of the housing pins are disposed behind the shoulder formed by the rotation of the rotor. The rotor can then be released for rotation. Unauthorized unlocking attempts of this kind impair the unlocking security of rotary closure cylinders. Unlocking security is understood by one skilled in the art to mean the degree of difficulty involved in circumventing the tumblers of a rotary closure cylinder using devices, without force, without knowledge about the affiliated key, and without destroying the lock.

OBJECT AND SUMMARY OF THE INVENTION

The object of the invention is to make the unauthorized unlocking attempts mentioned impossible or at least making them much more difficult. The object is attained according to the invention with the lock bolt mentioned, by virtue of the fact that the bolt tip is supported on the bolt head so that it can slide longitudinally in a limited fashion between an inner and an outer position.

BRIEF DESCRIPTION OF THE DRAWINGS

An exemplary embodiment of the invention is explained in detail below in conjunction with the drawings.

DETAILED DESCRIPTION OF THE INVENTION

Figure 1:
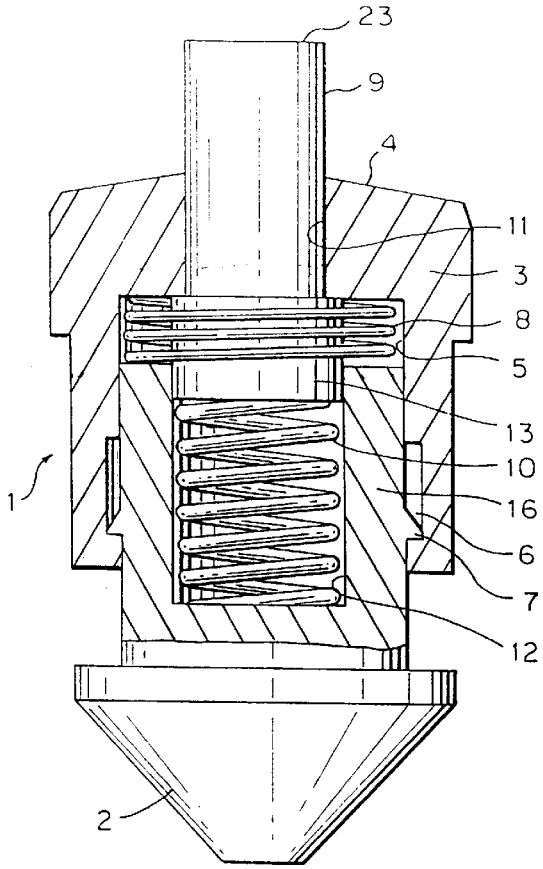
FIG. 1 shows a longitudinal section through a lock bolt according to a first embodiment of the invention.
Figure 2:
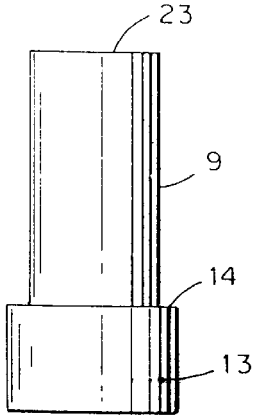
FIG. 2 shows a view of a part of the lock bolt.

The lock bolt 1 shown in the drawing has a bolt head 3 in which a bolt tip 2 and a pin 9 are supported so that they can slide. The bolt tip 2 has a peg-shaped projection 16 on which it can be longitudinally slid in a limited fashion in a longitudinal bore 5 of the bolt head 3. A compression spring 8 is supported against the bolt head 3 and against a back end 19 of the bolt tip 2 and secures the tip 2 in the outer position shown, which is defined by a stopping of an annular projection 7 against a shoulder 17. The shoulder 17 is constituted by an annular recess 6 on the inside of the bore 5. From the outer position shown, the bolt tip 2 can be slid into the bore counter to the opposing force of the spring 8, until the back end 19, of the tip 2 is stopped by the compressed spring 8 against the bottom 21 of the bore 5. The force of the spring 8 is significantly less than the force of the standard housing spring 26 which acts upon the back end of the associated housing pin 25.

Clearly, if the spring 8 were omitted, the bolt tip 2 would still be forced in the same direction (downward in the drawing) by its own weight. That is, the weight of the bolt tip 2 acts as a means for forcing the bolt tip 2 away from the bolt head 3.

Figure 3:
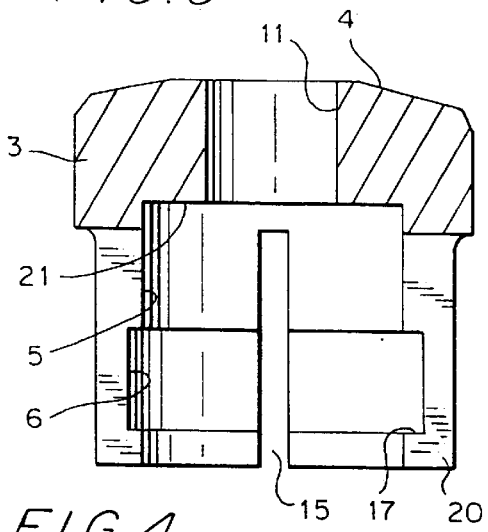
FIG. 3 shows a section through the bolt head.
Figure 4:
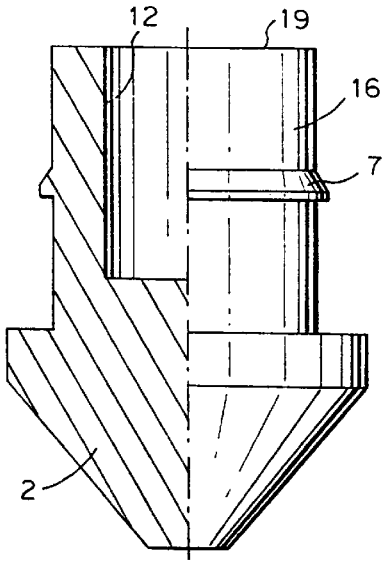
FIG. 4 shows a section through the bolt tip.

According to FIG. 3, the bolt head 3 has four slots 15 that form radially elastic tabs 20 so that the bolt tip 2 can be inserted into the bolt head 3 and is connected to it in captive fashion. When the bolt tip 2 is inserted into the bore 5, the annular projection 7 engages in detent fashion in the recess 6 by spreading the tabs 20. The bolt tip 2 is thus securely held in the bolt head 3 and furthermore, a simple assembly is possible and can be automated.

Figure 6:
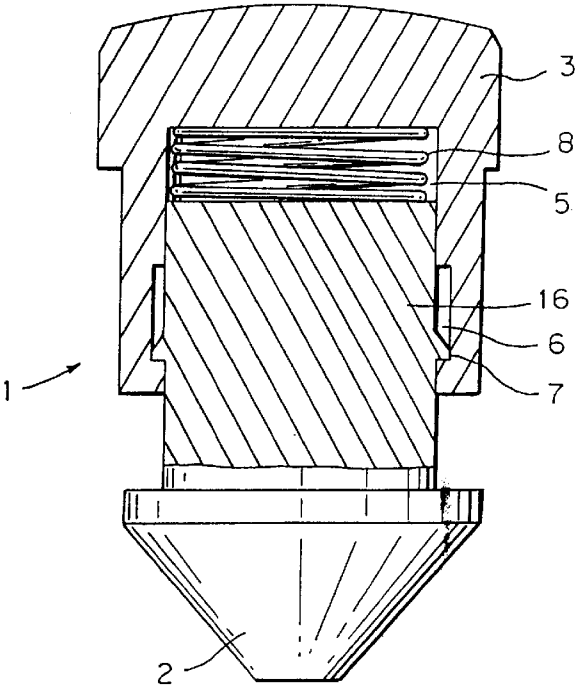
FIG. 6 shows a longitudinal section through a lock bolt according to a second embodiment of the invention.

A blind bore 12 is provided in the peg-shaped projection 16 on the back end; a pin 9 that is supported in another bore 11 of the bolt head 3 engages in this blind bore 12. In the position shown in FIG. 1, the pin 9 is brought so that a shoulder 14 of a head 13 rests against the bottom 21 of the bore 5 by means of the compression spring 10. In this position, the pin 9 protrudes beyond the back wall 4 of the bolt head 3. If the lock bolt 1 is inserted into a rotary closure cylinder 24, then the pin 9 is lowered by the action of the substantially stronger housing spring and the back end 23 of the pin 9 is flush with the back wall 4 of the bolt head 3. With a normal actuation of the closure cylinder 24, the pin 9 has no function and serves merely as a locking element in the event of an unauthorized unlocking attempt. For this, please also refer to the above mentioned WO 87/05654. As shown in FIG. 6, an embodiment is also conceivable in which this locking pin 9 is omitted. In this case as also shown in FIG. 6, the bore 11 in the bolt head 3, the bore 12 in the bolt tip 2, and the compression spring 10 are omitted from the first embodiment of FIG. 1 to create the embodiment of FIG. 6 with bore 5 being a blind bore.

Figure 5:
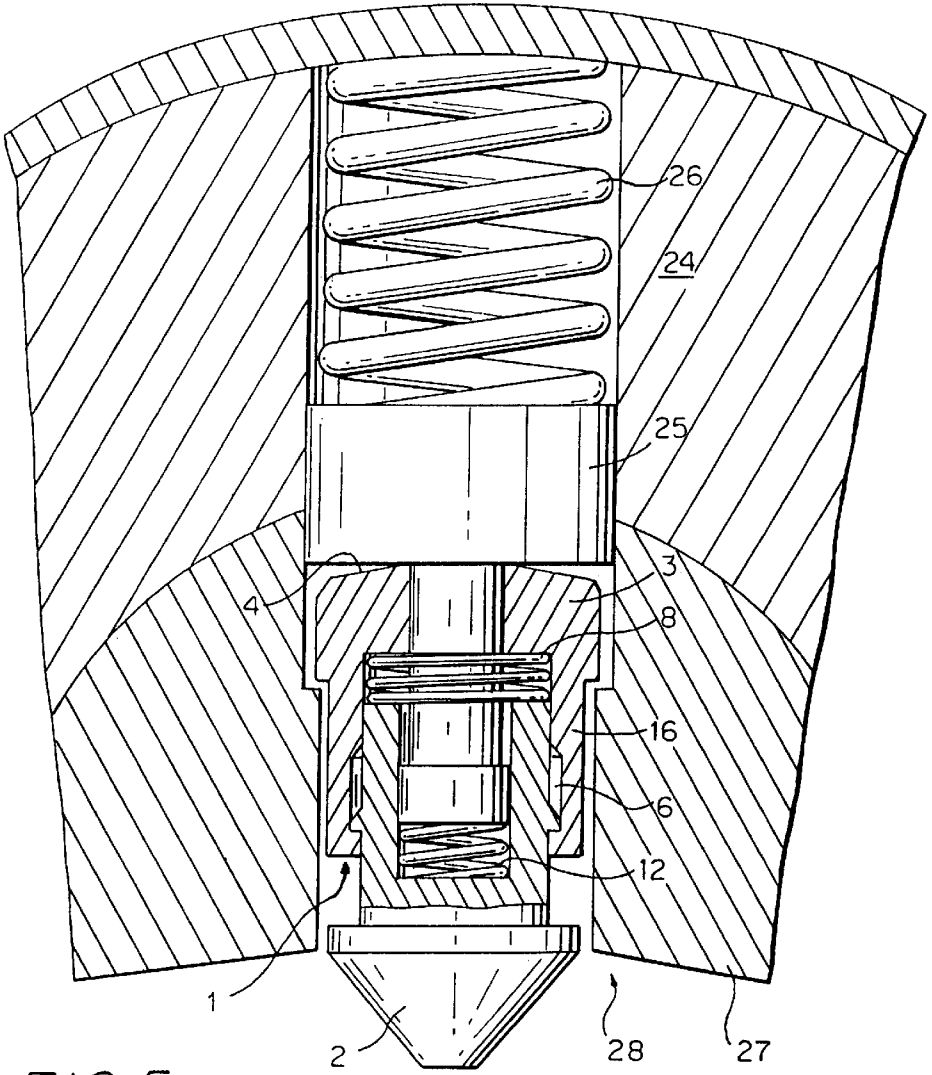
FIG. 5 shows a section through a conventional rotary closure cylinder and associated housing spring and pin with the lock bolt according to the invention.

When the lock bolt 1 is activated, as shown in FIG. 5, by rotation of an associated key inserted into the key channel 28 of the rotor 27, then first the bolt tip 2 in the bolt head 3 is slid until its back end 19 rests against compressed spring 8 against the bottom 21 of the bore 5 and back wall 4. Then the bolt head 3 is slid radially outward to slide of the housing pin 25 into rotary closure cylinder 24. In so doing, the housing pin 25 rests against the back wall 4 of the bolt head 3, as clearly shown in FIG. 5. The pin 9, if included, is lowered in the bolt head 3 and has no function, as mentioned. Consequently in the use provided, the lock bolt 1 essentially works like a conventional lock bolt. If a vibrational movement is exerted on the bolt tip 2 in an unauthorized, unlocking attempt, then this movement is essentially not transmitted to the back end 4 of the bolt head 3 and is thus ineffective due to the fact that the force of spring 8 is substantially less than the force of spring 26 so that the vibrational movement on tip 2 is absorbed by spring 8 and housing pin 25 is not slid into rotary closure cylinder 24.

A rotary closure cylinder 24 can have one lock bolt 1 or a number of them, preferably, though, several lock bolts 1 of a cylinder are embodied according to the invention.

What is claimed:

1. A lock bolt in a rotary closure cylinder (24) of a safety lock, said rotary closure cylinder (24) having a housing spring acting on a back end of an associated housing pin, said lock bolt having a bolt tip (2) and a bolt head (3) both of which are slidably located in a rotor of the safety lock, said bolt head (3) having a back wall engaged against the associated housing pin for sliding the associated housing pin into the rotary closure cylinder (24) when the rotor of the safety lock is rotated by a corresponding key, wherein the bolt tip (2) is supported in the bolt head (3) so that it is slidable longitudinally in a limited fashion between an inner position and an outer position;

wherein spring biasing means are engaged between the bolt tip (2) and the back wall (4) of the bolt head (3) for forcing the bolt tip (2) away from the bolt head (3);

said spring biasing means exerting a force between the bolt tip (2) and the bolt head (3) substantially less than a force exerted by the housing spring on the back end of the associated housing pin; and whereby a vibrational movement exerted on the bolt tip (2) is absorbed by said spring biasing means and is not transmitted to the bolt head (3) so that said associated housing pin is not slid into said rotary closure cylinder (24) to permit unauthorized opening of the safety lock.

2. The lock bolt according to claim 1, wherein the bolt head (3) has a longitudinal bore (5) in which the bolt tip (2) is supported so that it can slide.

3. The lock bolt according to claim 2, wherein the longitudinal bore (5) is a blind bore.

4. The lock bolt according to claim 2, wherein the longitudinal bore (5) has a lateral recess (6) in which a projection (7) of the bolt tip (2) is engaged in detent fashion.

5. The lock bolt according to claim 3, wherein the longitudinal bore (5) has a lateral recess (6) in which a projection (7) of the bolt tip (2) is engaged in detent fashion.

6. The lock bolt according to claim 2, wherein said spring biasing means includes a first spring element (8) supported in the bolt head (3) and secures the bolt tip (2) in a position of repose in the outer position.

7. The lock bolt according to claim 3, wherein said spring biasing means includes a first spring element (8) supported in the bolt head (3) and secures the bolt tip (2) in a position of repose in the outer position.

8. The lock bolt according to claim 4, wherein said spring biasing means includes a first spring element (8) supported in the bolt head (3) and secures the bolt tip (2) in a position of repose in the outer position.

9. The lock bolt according to claim 6, wherein the bolt tip (2) can be slid from the outer position into the inner position counter to the force of the spring element (8).

10. The lock bolt according to claim 1, wherein a locking pin (9) is supported in the bolt head (3), protrudes out the back wall (4) of the bolt head (3), and can be lowered counter to a second spring element (10) into the bolt head (3).

11. The lock bolt according to claim 2, wherein a locking pin (9) is supported in the bolt head (3), protrudes out the back wall (4) of the bolt head (3), and can be lowered counter to a second spring element (10) into the bolt head (3).

12. The lock bolt according to claim 4, wherein a locking pin (9) is supported in the bolt head (3), protrudes out the back wall (4) of the bolt head (3), and can be lowered counter to a second spring element (10) into the bolt head (3).

13. The lock bolt according to claim 6, wherein a locking pin (9) is supported in the bolt head (3), protrudes out the back wall (4) of the bolt head (3), and can be lowered counter to a second spring element (10) into the bolt head (3).

14. The lock bolt according to claim 9, wherein a locking pin (9) is supported in the bolt head (3), protrudes out the back wall (4) of the bolt head (3), and can be lowered counter to a second spring element (10) into the bolt head (3).

15. The lock bolt according to claim 10, wherein the second spring element (10) acting on the pin (9) is disposed in a longitudinal bore (12) of the bolt tip (2).

16. The lock bolt according to claim 8, wherein a longitudinal bore (12) of the bolt tip (2) opens into a peg-shaped projection (16) of the bolt tip (2).

17. The lock bolt according to claim 1, wherein the rotary closure cylinder (24) has at least one lock bolt.

18. The lock bolt according to claim 1, wherein the bolt tip (2) includes a peg-shaped projection (16) on a back side thereof, whereby the peg-shaped projection is slidable longutidinally.

19. A lock bolt in a rotary closure cylinder of a safety lock, comprising a bolt tip (2) and a bolt head (3);

said bolt tip (2) and bolt head (3) being slidably located in a rotor of said safety lock;

the bolt head (3) being placed against a housing pin for sliding the associated housing pin into the rotary closure cylinder (24) when the rotor of the safety lock is rotated by a corresponding key;

a compression spring (8) in a blind bore of the bolt head (3) engaged between the bolt tip (2) and the bolt head (3); and the bolt tip (2) being supported in the bolt head (3) so that it is slidable longitudinally in a limited fashion between an inner and an outer position, whereby a vibrational movement exerted on the bolt tip (2) is absorbed by the compression spring (8) and is not transmitted back to the bolt head (3) to slide said associated housing pin into said rotary closure cylinder (24).

* * * * *